US006394298B1

(12) United States Patent
Zaidman

(10) Patent No.: US 6,394,298 B1
(45) Date of Patent: May 28, 2002

(54) DISPENSING COVER

(75) Inventor: Uri Zaidman, Tel Aviv (IL)

(73) Assignee: Albaad Massuot Yitzhak Ltd, Massout Yitzhak (IL)

( * ) Notice: Subject to any disclaimer, the term of this patent is extended or adjusted under 35 U.S.C. 154(b) by 0 days.

(21) Appl. No.: 09/567,101

(22) Filed: May 8, 2000

(30) Foreign Application Priority Data

May 10, 1999 (IL) ..... 129856

(51) Int. Cl.[7] ..... B65D 43/16

(52) U.S. Cl. ..... 220/254; 220/827; 220/835; 206/494

(58) Field of Search ..... 220/254, 259, 220/281, 283, 833–835, 827, 838, 837, 847; 206/233, 494; 221/63

(56) References Cited

U.S. PATENT DOCUMENTS

| | | | | |
|---|---|---|---|---|
| 3,982,659 A | | 9/1976 | Ross | |
| 4,185,754 A | | 1/1980 | Julius | |
| 4,739,900 A | * | 4/1988 | Borst | |
| 5,699,912 A | * | 12/1997 | Ishikawa et al. | 206/494 |
| 6,206,221 B1 | * | 3/2001 | Brando et al. | 220/835 |

FOREIGN PATENT DOCUMENTS

| | | | |
|---|---|---|---|
| EP | 0748 748 A | | 12/1996 |
| EP | 0 953 313 A | | 11/1999 |
| JP | 10-81351 | * | 3/1998 |
| JP | 11-49210 | * | 2/1999 |
| JP | 11-79214 | * | 3/1999 |
| JP | 11-79215 | * | 3/1999 |
| JP | 11-79216 | * | 3/1999 |

* cited by examiner

*Primary Examiner*—Nathan J. Newhouse
(74) *Attorney, Agent, or Firm*—Nath & Associates PLLC; Gary M. Nath; Marvin C. Berkowitz

(57) ABSTRACT

A dispensing cover for a container accommodating an article to be dispensed, such as a wet towel. The surface of the cover has an opening therein providing access to the article, and a hinged lid of deformable, elastic material swingable from an erect, open position to expose the opening to a position overlying and closing the opening, the lid having at its front end a locking element. Cooperating with the lid is a locking member coupled to the surface of the cover, the member having a locking edge which when the lid is closed, then engages the locking element to maintain the lid in a closed state. To open the lid, the locking member is depressed to deform the lid to an extent effecting disengagement of the locking element from the locking edge to permit the lid to spring up as a result of the elastic energy it gained when being deformed.

13 Claims, 8 Drawing Sheets

DISPENSING COVER

FIELD OF THE INVENTION

The present invention is generally in the field of container covers and more specifically it is concerned with a dispensing cover fitted with a re-closable lid.

BACKGROUND OF THE INVENTION

It is often required to provide a container with a cover fitted with an opening having restricted dimensions for withdrawal of items contained within the container. Such covers are collectively referred to as "dispensing covers". However, it is to be understood that such covers are often suitable also for inserting items into the container.

It is advantageous to have a cover fitted with an opening, the latter being covered by a lid which may be manually or automatically opened. Automatically operated lids are operated, for example, by electric motors or by mechanical mechanisms (e.g. spring biased or such comprising links and levers, etc.).

Manually operated lids are at times inconvenient in use where both hands of the user are required to open the lid or cover, in particular when the operator has one hand occupied.

One such typical example refers to withdrawing cotton-wool or a wet disposable towel from a container, while a person's hands are greasy or while attending to a baby, etc. Furthermore, in many cases there is provided a lid-biasing member which require manufacturing and assembling into the cover. Such a biasing member loses its resiliency after a while and may fall and get lost.

It is thus an object of the present invention to provide a cover for a container, the cover being fitted with an opening closable by a lid, wherein for opening the lid only one hand is required. By one preferred embodiment, opening the lid is carried out by depressing a locking member, and whereby the lid springs into an open position and remains in this position, whereby the opening is accessible.

SUMMARY OF THE INVENTION

According to the present invention there is provided a cover for a container which cover is suitable for wise either as a dispensing cover or for inserting items into the container.

According to a first embodiment of the invention there is provided a dispensing cover for a container, the cover comprising an opening communicating with an interior space of the container, and a lid having a rear end and a front end, the lid being swingably articulated at or adjacent its rear end to the cover and being displaceable between a first, open position in which it is essentially erect with respect to a surface of the cover, and a second, closed position in which it rests over the opening; the lid is formed at a front side edge thereof with a laterally projecting tab, wherein depressing the tab entails elastic deformation of the lid whereby instantaneously releasing the tab causes the lid to spring into its first position.

It is an important characterizing feature of the invention that the lid is not spring biased, but rather displaces into its first, erected position by the elastic energy gained while it is deformed. This arrangement avoids that use of an additional biasing member, typically a leaf-like elastic member.

In accordance a second preferred embodiment according to the present invention, the cover is characterized in that:

the lid is formed at a front side edge thereof with a laterally locking element, the cover is fitted at a front portion thereof with a locking member having a locking edge at a rear edge thereof; the locking member is displaceable between a first position in which the locking edge is engaged with the locking element of the lid when the latter is in its second position, and a second, depressed position:

wherein depressing the locking member into the second position entails elastic deformation of the lid whereby the locking element disengages from the locking edge and the lid and springs into its first position.

In order to prevent spontaneous opening of the lid, the locking member is restrained from upward displacement from its first position.

By still a modification, the locking element is a laterally extending rib or recess and the locking edge is formed with a corresponding lateral rib or recess engageable with the rib or recess of the lid. Preferably, the locking member is formed as an internal portion of the cover which is as such deformable upon depression thereof. By a modification, the locking member is articulated to the cover.

By a preferred embodiment of the cover of the present invention, while in the second position, at least the lid is essentially lush with a top surface of the cover. Still preferably, the locking member is also essentially flush with the top surface of the cover.

In accordance with one embodiment, the lid and the locking member are received within corresponding portions of the cover which are depressed or removed.

The term "removed" refers to portions of the cover which are absent.

By one application of the invention, portions of the cover extending below a front portion of the lid and below at least a rear portion of the locking member are depressed or removed so as to allow downward displacement of a front portion of the lid and a rear portion of the locking member.

By another application, at least a front portion of the lid and a rear portion of the locking member are thinner than other portions thereof, so as to allow downward displacement of a front portion of the lid and a rear portion of the locking member.

By one preferred design, the portion of the cover below the lid is formed with an opening suitable for dispensing tissue towels and preferably for dispensing moistured tissue towels, one at a time. By other designs, the opening is suitable for dispensing other goods, as may be required, e.g. cotton-wool etc,.

At times it is desirable that the contents of the container be kept in sealed conditions, e.g. in case of wet tissue towels. Thus, in accordance with one embodiment of the invention, when the lid is in its second position it sealingly rests over the opening of the cover. For improving the sealing engagement, suitable ribs or other sealing arrangements may be provided as known per se.

By one specific embodiment, either or both of the lid and corresponding portions of the cover are formed with abutments for supporting the lid in its second position. Typically, such abutments are provided at a rear portion so as to enable displacement of the front portion of the lid, while in its second position.

By one preferred embodiment, either or both the lid and the locking member are integrally formed with the cover whereby the respective integral member is pivotable about an integral hinge. Alternatively, either or both of the lid and locking member are pivotally hinged to the cover via an axle.

The lid is typically made of a polymeric material wherein the strain caused by displacement of the lid by the locking member is within the elastic zone, i.e. the lid does not plastically deform.

By one specific design, the lid comprises reinforcing ribs at least at a rear portion thereof.

Preferably, the container is rigid and by one specific design the container is adapted for refilling whereby the cover is refittable over the container.

BRIEF DESCRIPTION OF THE DRAWINGS

In order to understand the invention and to see how it may be carried out in practice, some preferred embodiments will now be described, by way of non-limiting examples only, with reference to the annexed drawings, in which.

DETAILED DESCRIPTION OF A PREFERRED EMBODIMENT

Figure 1A:
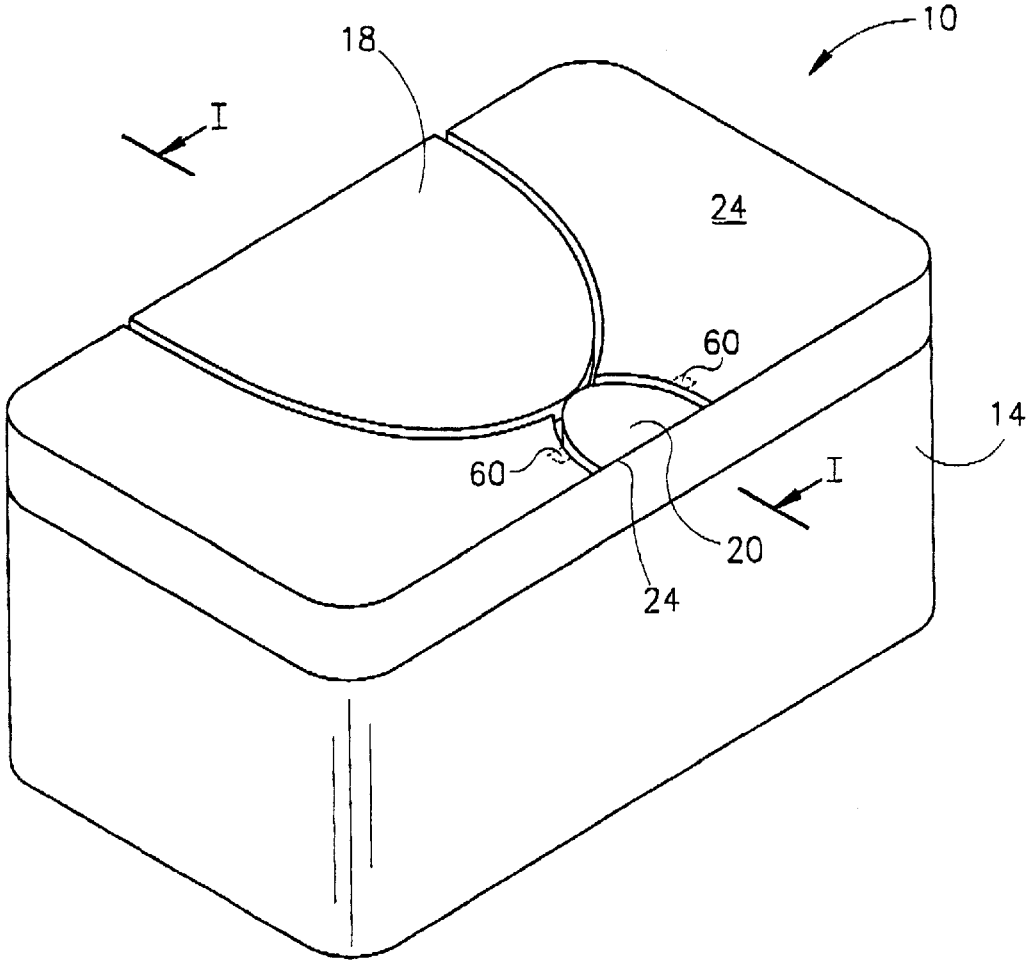
FIG. 1A is a perspective view of a cover in accordance with a first embodiment of the invention, with a lid of the cover in a closed position.

Attention is first directed to FIG. 1A providing a general view of the cover which is generally designated 10. The cover is mounted over a rectangular container 14, which for the sake of simplicity will not be illustrated in the following drawings. However, it will be noted that the container 14 is of known design and may be removably attached to the cover 10 for refilling, as may be required. It is also appreciated that the cover may be integral with the container or mounted thereon, fixedly or removably.

The cover 10 has an overall rectangular shape and comprises a lid 18 and a locking member 20 which, as will become apparent hereinafter, are both integrally formed with the cover 10, and made of a suitable polymeric material.

Figure 1B:
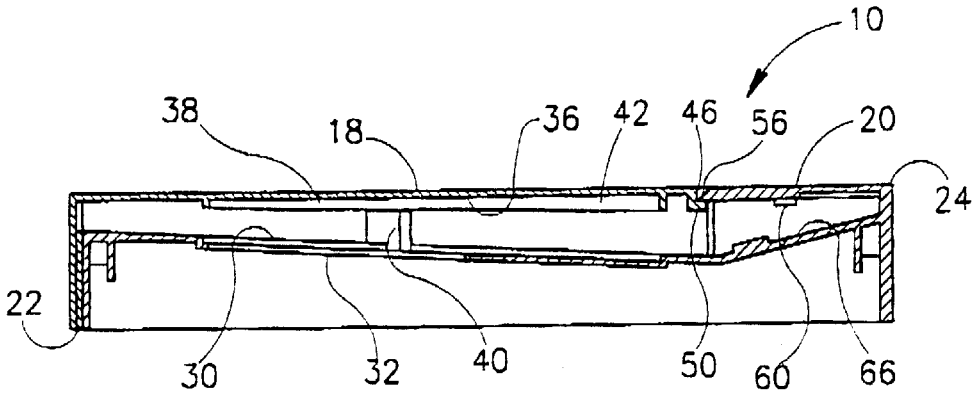
FIG. 1B is a sectional view through line I—I in FIG. 1A.

The skilled person will realize however, that other suitable materials may be used as well. Furthermore, the lid and the locking member may also be not integrally with the cover, as will become apparent hereinafter.

in FIGS. 1A and 1B, the lid 18 is in a so-called closed position with both the lid 18 and locking member 20 being flush with the top surface 24 of the cover 10.

Figure 2A:
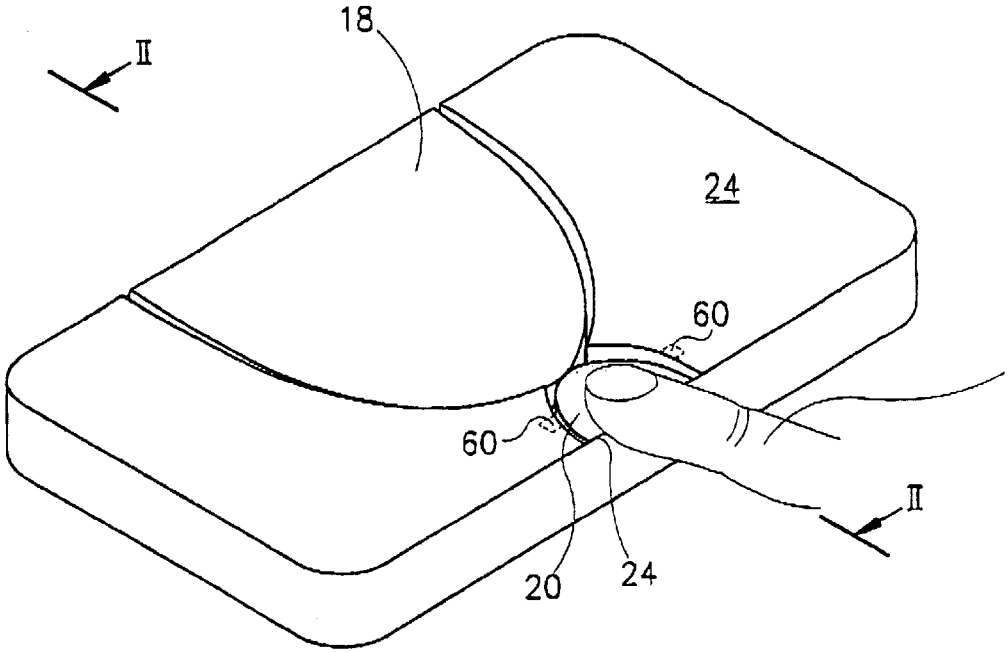
FIG. 2A is an isometric representation illustrating how the lid of the cover seen in FIG. 1A is being opened.
Figure 2B:
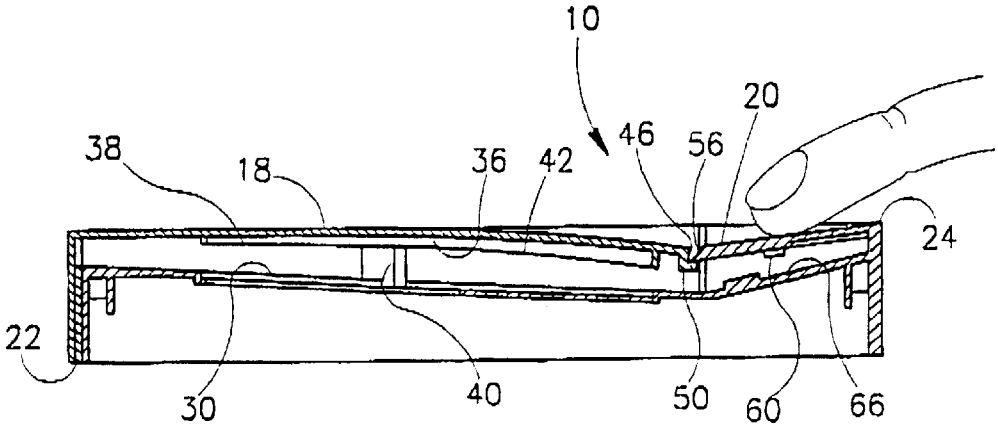
FIG. 2B is a sectional view along line II—II in FIG. 2A.
Figure 3:
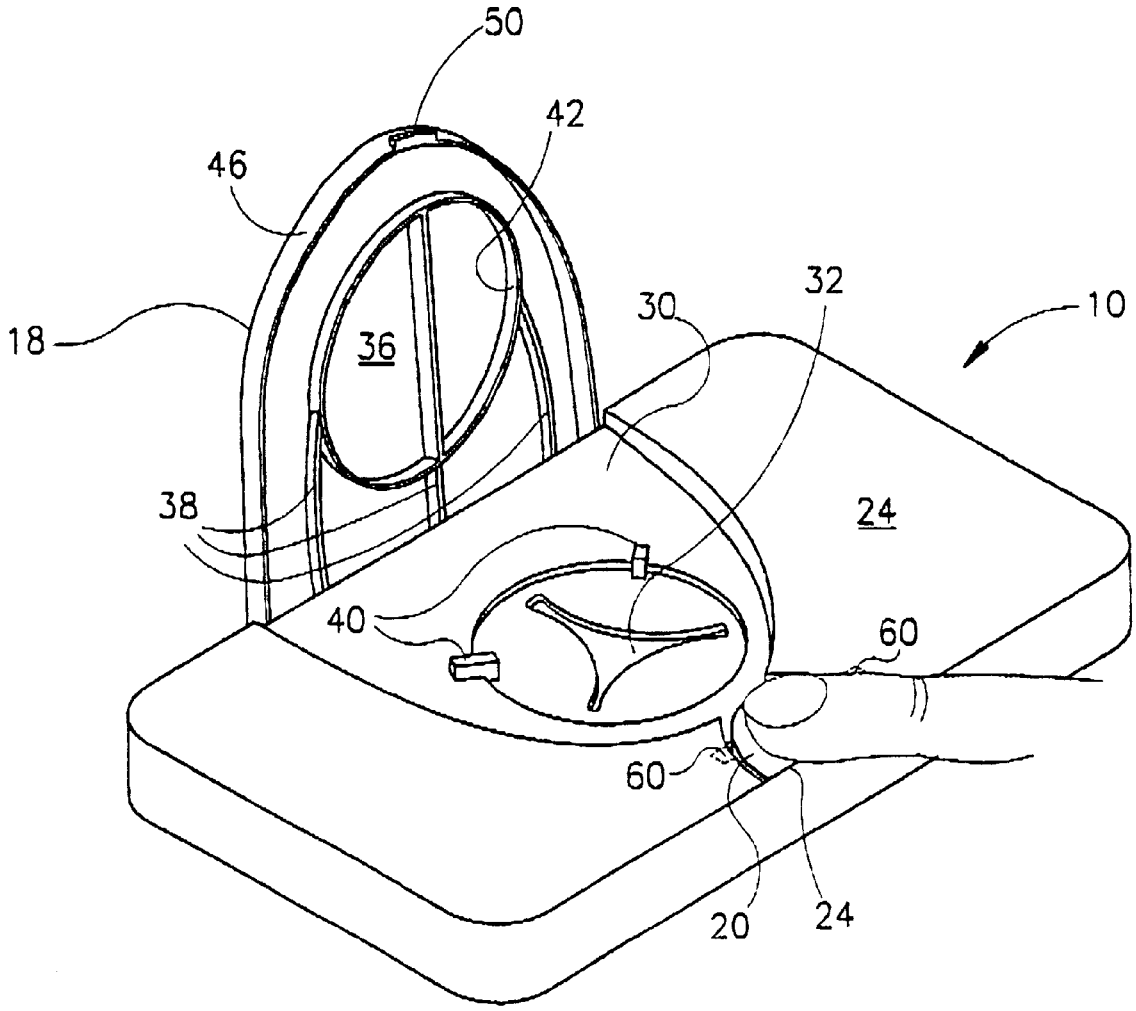
FIG. 3 is an isometric view of the cover of FIGS. 1 and 2 in its open position.

As can be seen and understood from FIGS. 1–3, the lid 18 and the locking member 20 are integrally formed with the cover 10 and are both pivotal about an integral hinge 22 and 24, respectively (the former seen only in FIGS. 1B and 2B, the latter seen also in FIGS. 1A, 2A and 3).

Both the lid 18 and the locking member 20 are received within suitable depressions formed in the cover 10 whereby the lid and the locking member are flush with the top surface 24 of the cover. Depression 30 corresponds with the shape of the lid 18 and comprises an opening 32 which is adapted to allow withdrawal of wet tissue towels, e.g. towels which are arranged in a continuous, perforated roll or, towels arranged in a so-called pop-up package. However, other forms of opening are available, at manufacturer's choice, depending also on the goods to be contained in the container.

As can be seen in FIGS. 1B, 2B and 3, the lid 18 is formed at its bottom surface 36 with a plurality of reinforcing ribs collectively referred to as 38. The depression 30 is formed with two abutting projections 40 which extend upwards so as to engage with the reinforcing ribs 38 and retain the lid 18 in its closed position, flush with the surface 24 of the cover 10.

It is noted that lid 18 comprises also a circular rib portion 42 which is adapted both for reinforcing the lid and for encircling the aperture 32. The artisan will no doubt be able to design sealing arrangements of the opening which all fall within the scope of the present invention. Detailed description of sealing arrangements are seen in FIG. 7.

At a front side edge 46 of lid 18 there is formed a laterally projecting locking rib 50 (see FIGS. 1B, 2B and 3) and the locking member 20 is formed with a locking edge 56 (see FIGS. 1B and 2B) which in the closed position of the lid overrides the locking rib 50, thus preventing upward displacement of the lid 18.

The arrangement is such that the locking member 20 is restrained from upward displacement by means of laterally extending projections 60 seen in dashed lines in FIGS. 1A and 2A. This arrangement ensures that while the locking edge 56 of locking member 20 overrides the locking rib 50 of lid 18, the lid 18 is in its closed position, prevented from spontaneously opening into an erected position.

Depression 30 of cover 10, as clearly seen in FIGS. 1B and 2B, is inclined in a manner that its portion extending below a front portion of the lid 18 is deeper depressed than a rear portion thereof. Similarly, depression 66 accommodating locking member 20 is inclined in a reverse direction and coincides with depression 30, the arrangement being such that the rear portion of the depression 66 is deeper than its front portion. A skilled person will appreciate that the bottom surfaces of the depression may also be otherwise formed, namely smooth etc.

In the closed position of lid 18, seen in FIGS. 1A and 1B, the lid is at rest over the opening 32, with essentially no mechanical stress. When, however, it is desired to open the lid 18, locking member 20 is depressed by the user's finger 68 (FIG. 2) displacing the locking member downward against the elasticity of lid 18, whereby the lid 18 deforms as can best be seen in FIG. 2B, whereby the locking edge 56 slides upon the locking rib 50 of lid 18, eventually disengaging therefrom whereby lid 18 springs open into its erected position seen in FIG. 3, releasing the mechanical stress imparted to the lid while deformation.

It is pointed out that the deformation of lid 18 by depression of locking member 20 is within the allowed mechanical elastic zone, i.e. ensuring that the lid 18 retains its flat original shape upon seizing of the force applied onto the locking member 20.

The hinging arrangement is such that the lid 18 springs into its open position to an angle which is greater than 90°, whereby the lid remains in its open position until it is manually closed again by merely depressing the lid 18, whereby the locking rib 50 snapingly slides over the locking edge 56 of locking member 20 into the locking position as explained hereinbefore with reference to FIG. 1. Other arrangements for retaining the lid in open position are available to.

Figure 4A:
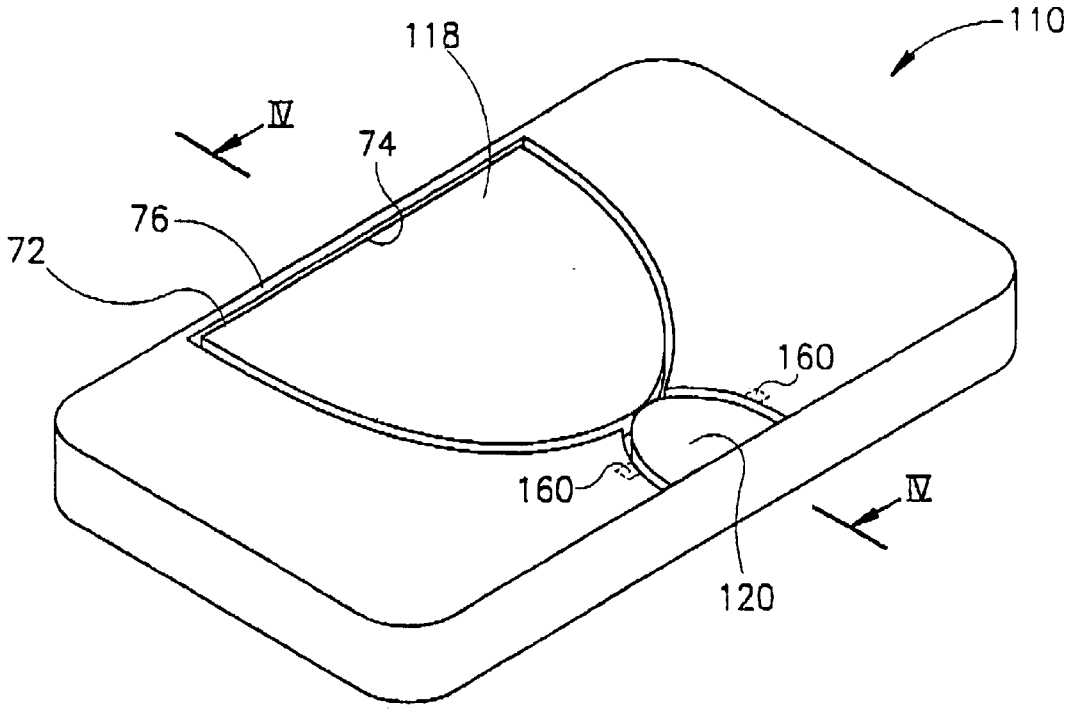
FIG. 4A is an isometric view of a cover in accordance with another embodiment of the present invention, with a lid formed in the cover, the lid in its closed state.
Figure 4B:
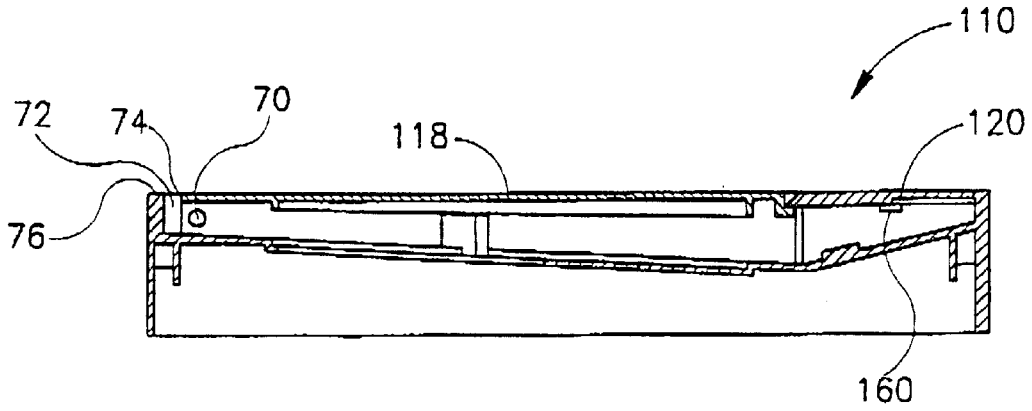
FIG. 4B is a sectional view along line IV—IV in FIG. 4A.
Figure 5A:
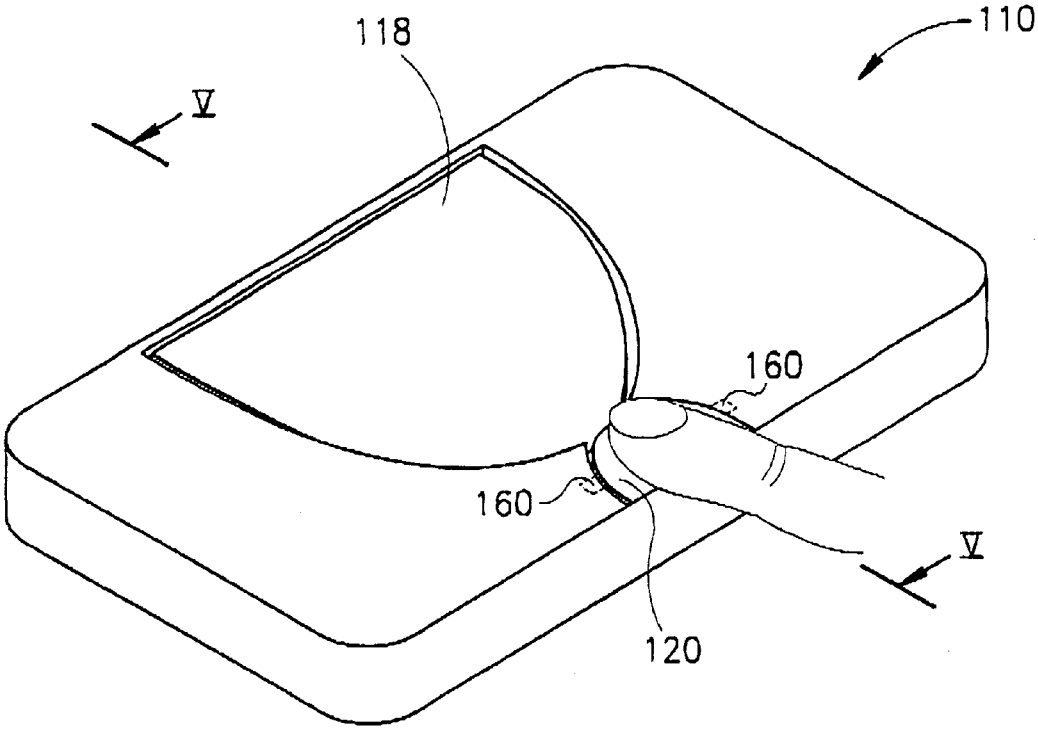
FIG. 5A is an isometric representation illustrating how the lid of the cover seen in FIG. 4A is being opened.
Figure 5B:
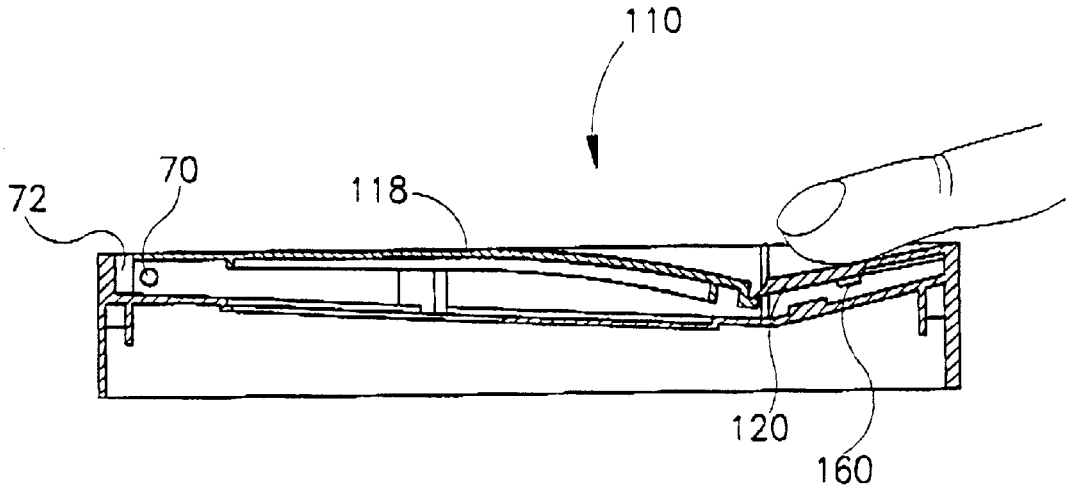
FIG. 5B is a section view alone line V—V in FIG. 5A.
Figure 6:
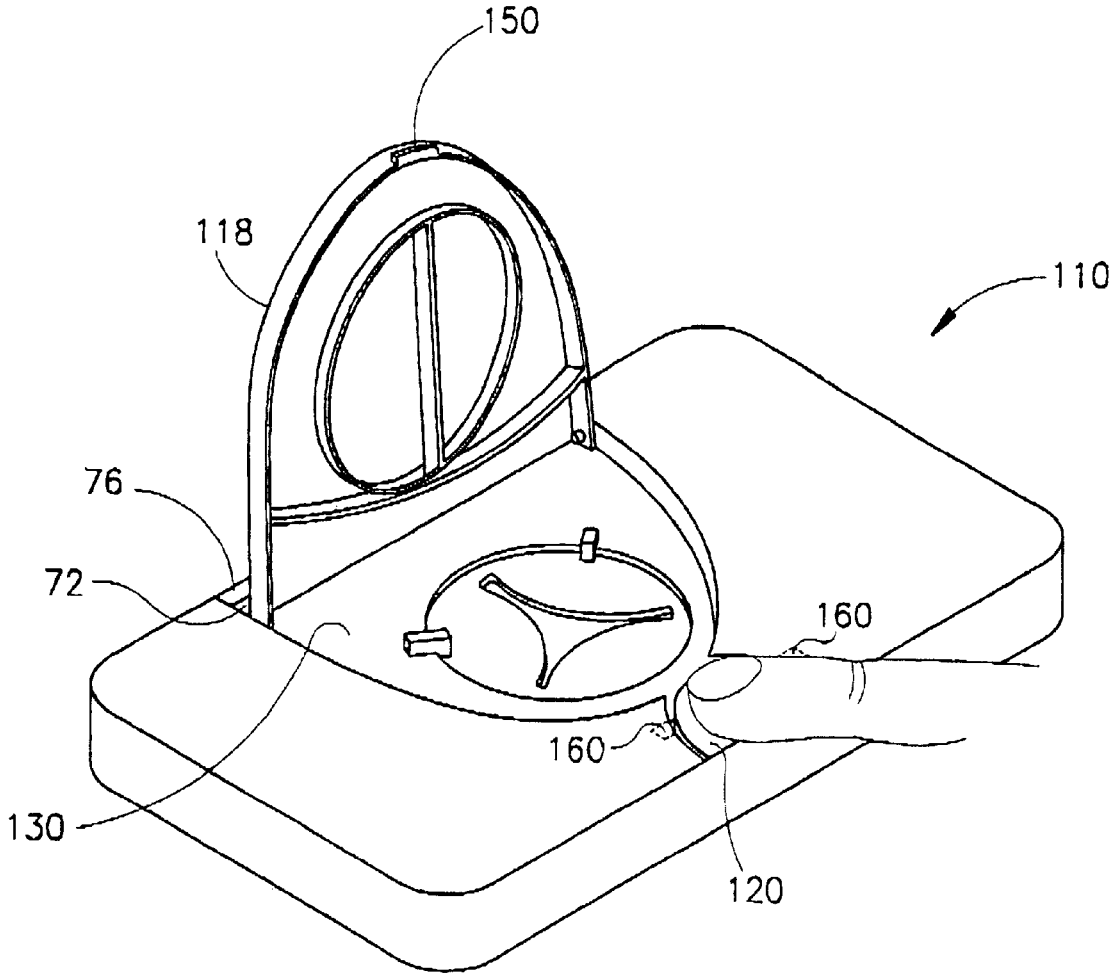
FIG. 6 is an isometric view of the cover of FIGS. 4 and 5 in its open position.

The embodiment seen in FIGS. 4–6 is principally similar to the previous embodiment and accordingly, like elements have been given like reference numerals shifted by 100, and the reader is directed to those paragraphs referring to the description of FIGS. 1–3 for more details.

As noted, the cover 110 comprises a lid 118 and a locking member 120. Lid 118 rather than being integrally hinged with the cover 110 is pivotally hanged at axle 70 to the cover and as seen in particular in FIGS. 4B and 5B. According to this embodiment, at least the lid 118 is made of a suitable polymeric material.

There exists a gap 72 between the rear edge 74 of lid 118 and the edge 76 of the depression 130 accommodating the lid. This arrangement ensures that when the lid 118 erects into its open position (seen in FIG. 6) it remains in this position as it displaces beyond a 90° position.

Apart from this difference, the features of FIGS. 4–6 are principally similar with those of the previous embodiment depicted in FIGS. 1–3 and the manner of operation is similar as well.

Figure 7A:
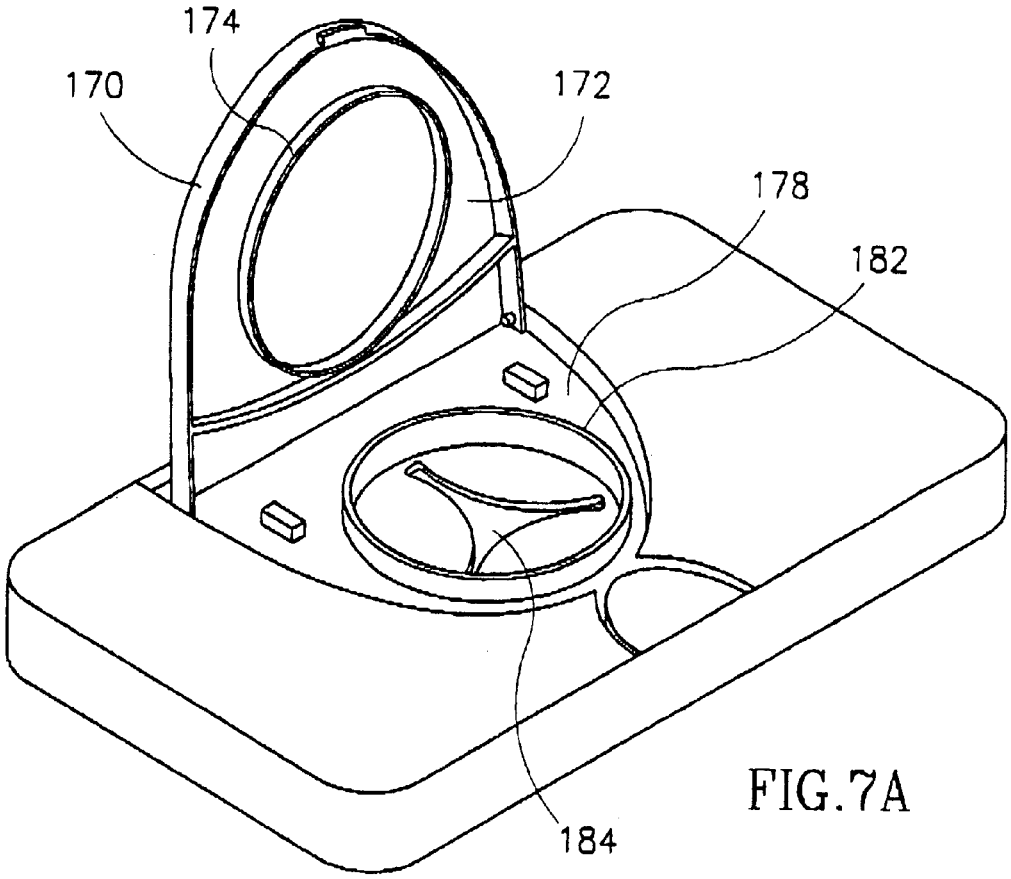
FIG. 7A is an isometric view of a cover fitted with sealing means, the cover in its open position.
Figure 7B:
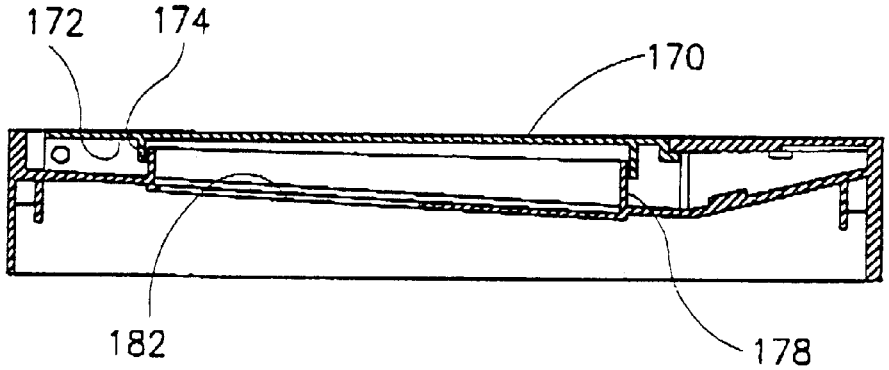
FIG. 7B is a sectional view of the cover of FIG. 7A, in its closed position.

Referring now to FIGS. 7A and 7B the lid 170 is formed at its bottom surface 172 with a circumferential sealing rib 174 and the cover is formed at the depression 178 with an upwardly extending circumferential rib 182 having an outer diameter slightly less than the inner diameter of the rib 174 and encircling the opening 184 of the cover. The arrangement is such that in the closed position (FIG. 7B) rib 182 sealingly fits within the rib 174 of the lid 170.

Whilst in the embodiments illustrated and ascribed so far the locking member 20 constitutes an integral part of the cover 24 and is particulatedly hinged to the cover at 24, there exists further options. For example, the locking member may be continuous with the cover 24 and may then be formed as a weakened zone formed with a recess engageable by locking rib (50 in FIG. 1B) whereupon depression thereof entails its deformation forcing together the lid 18 into its second, depressed position whereupon further depression results in release of the locking rib allowing spontaneous displacement of the lid into its open position.

Figure 8A:
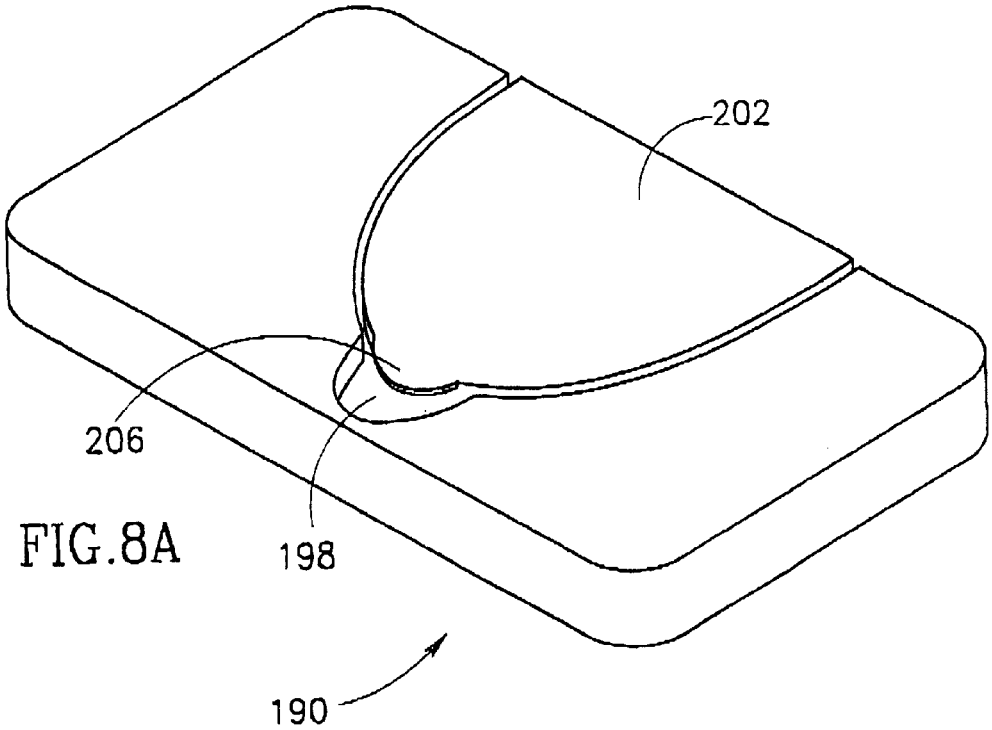
FIG. 8A is an isometric view of a cover according to another embodiment of the invention, the lid in its closed position.
Figure 8B:
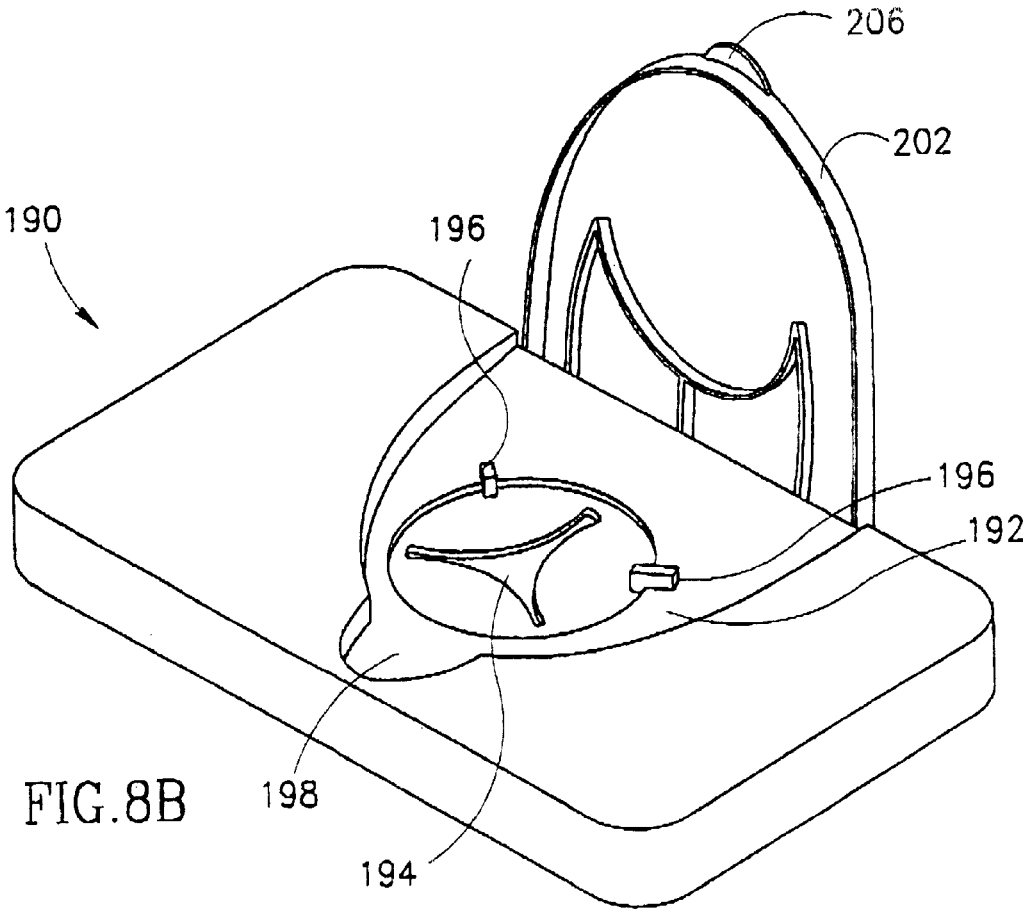
FIG. 8B is an isometric view of the cover of FIG. 8A, in its open position.

In FIG. 8 of the drawings there is illustrated another embodiment of the invention wherein the cover generally designated 190 is formed with a depression 192 having an opening 194 communicating with an interior space of the container (not shown). The cover is also formed with two upwardly projecting abutting projections 196 and a finger portion 198 depressed at a front portion of the cover. There is further provided a lid 202, which in the present example is integrally formed with the cover and is swingable thereabout. The lid 202 displaceable between a first, open position in which it is essentially erect (FIG. 8B), and a second, closed position in which it rests over the opening (FIG. 8A).

The lid 202 is formed at its front side edge with a laterally projecting tab 206, wherein depressing the tab entails elastic deformation of the lid 202 whereby instantaneously releasing the tab causes the lid to spring into its first position.

It will be appreciated to a person versed in the art that the design and structure of the cover in accordance with the present invention may be different than the specific design illustrated hereinbefore. For example, the shape of each of the components may differ so as to suit different containers and different requirements.

What is claimed is:

1. A dispensing cover for a container having an interior space to accommodate an article to be dispensed, said cover comprising:

A. a surface having an opening therein providing access to the article;

B. a lid formed of elastic, deformable material having a rear end and a front end, said lid being swingably articulated from the rear end thereof so that it can swing from an erect, open position to expose the opening to a closed position at which it overlies the opening;

C. a locking element formed at the front end of the lid; and

D. a locking member cooperating with the lid coupled to the surface of the cover and provided with a locking edge adjacent the locking element of the lid, said locking member being displaceable from a first position at which the locking edge engages the locking element to maintain the lid in a closed state, to a second position at which the locking member is depressed to deform the lid an extent effecting disengagement to permit the lid to spring up as a result of elastic energy it gained when being deformed.

2. A dispensing cover according to claim 1, wherein the locking member is an integral position of the cover which is a zone defromable upon depression.

3. A dispensing cover according to claim 2, wherein at the second position, the lid is essentially flush with a top surface of cover.

4. A dispensing cover according to claim 1, wherein the locking member is articulated to the cover.

5. A dispensing cover according to claim 1, wherein at least a front portion of the lid and a rear portion of the locking member are thinner than other portions thereof, so as to allow downward displacement of said front portion of the lid and said rear portion of the locking member.

6. A dispensing cover according to claim 1, wherein the locking element is in a laterally extending rib and the locking edge is formed with a corresponding lateral rib engageable with the rib of the lid.

7. A dispensing cover according to claim 1, wherein the lid in the closed state sealingly rests over the opening formed in the cover.

8. A dispensing cover according to claim 1, wherein either or both the lid and the locking member are pivotable about the cover by internal hinges.

9. A dispensing cover according to claim 1, wherein either or both the lid and the locking member are pivotally hinged to the cover via an axle.

10. A dispensing cover according to claim 1, wherein the lid is made of polymeric material and wherein strain caused by deformation of the lid by the locking member is within an elastic zone.

11. A dispensing cover according to claim 1, wherein the lid comprises reinforcing ribs at a rear portion thereof.

12. A dispensing cover according to claim 1, wherein both the lid and the locking member are integrally formed with the cover.

13. A dispensing cover according to claim 1, wherein the locking member is restrained from upward displacement from its first position.

* * * * *

UNITED STATES PATENT AND TRADEMARK OFFICE

CERTIFICATE OF CORRECTION

PATENT NO. : 6,394,298 B1
DATED : May 28, 2002
INVENTOR(S) : Uri Zaidman

It is certified that error appears in the above-identified patent and that said Letters Patent is hereby corrected as shown below:

Column 6,
Line 30, after "a zone" and before "upon depression", please replace "defromable" to -- deformable --.

Signed and Sealed this

Twenty-fourth Day of September, 2002

*Attest:*

*Attesting Officer*

JAMES E. ROGAN
*Director of the United States Patent and Trademark Office*